United States Patent [19]

Fukui et al.

[11] Patent Number: 4,852,868

[45] Date of Patent: Aug. 1, 1989

[54] AUTOMATIC PAPER FEEDING APPARATUS

[75] Inventors: Kazuyuki Fukui; Chujiro Yokoyama, both of Osaka, Japan

[73] Assignee: Minolta Camera Kabushiki Kaisha, Osaka, Japan

[21] Appl. No.: 164,836

[22] Filed: Mar. 7, 1988

[30] Foreign Application Priority Data

Mar. 9, 1987 [JP] Japan ..... 62-53759

[51] Int. Cl.[4] ..... B65H 3/52

[52] U.S. Cl. ..... 271/122; 271/124; 271/125

[58] Field of Search ..... 271/121, 122, 124, 125, 271/126, 127, 10

[56] References Cited

U.S. PATENT DOCUMENTS

| | | | |
|---|---|---|---|
| 2,104,630 | 1/1938 | Zahn | 271/122 |
| 2,836,416 | 5/1958 | Van Marle | 271/122 |
| 2,995,362 | 8/1961 | Levy | 271/122 |
| 4,509,737 | 4/1985 | Shiozawa | 271/125 |
| 4,515,358 | 5/1985 | Fukui | 271/122 |
| 4,566,684 | 1/1986 | Gysling | 271/122 X |
| 4,586,705 | 5/1986 | Satoh et al. | 271/125 X |
| 4,627,607 | 12/1986 | Ishii | 271/122 |

FOREIGN PATENT DOCUMENTS

| | | | |
|---|---|---|---|
| 58-158048 | 4/1982 | Japan . | |
| 166447 | 7/1986 | Japan | 271/125 |
| 36246 | 2/1987 | Japan | 271/124 |

*Primary Examiner*—H. Grant Skaggs
*Attorney, Agent, or Firm*—Burns, Doane, Swecker & Mathis

[57] ABSTRACT

An automatic paper feeding apparatus which automatically feeds sheets one by one to an image forming portion, comprises a sheet storing plate, a paper-feeder roller for feeding sheets stored on the sheet storing plate, a transport roller positioned at the downstream relative to the paper-feeder roller in the paper feeding direction and rotatable in the paper feeding direction, a separation roller touching and pressing the transport roller and rotatable in the reverse direction to the paper feeding direction, a supporting plate for rotatably supporting the separation roller and being pivotably provided to move in the direction where the separation roller touches with and separates from the transport roller and being urged by an elastic member so as to cause the separation roller to be pressed toward the transport roller, and a guide plate for guiding a sheet into the nipping portion between the transport roller and the separation roller. The guide plate can leave and enter a paper feeding path integrally with or independent of the supporting plate. In the apparatus, sheets are fed from the top sheet by the rotation of the paper-feeder roller, and guided into the nipping portion between the transport roller and the separation roller. Then, out of the sheets having been guided into the nipping portion, only the top sheet is fed to the downstream, which the other sheets are fed back by the rotation of the separation roller.

6 Claims, 3 Drawing Sheets

AUTOMATIC PAPER FEEDING APPARATUS

BACKGROUND OF THE INVENTION

1. Field of the Invention

The present invention relates to an automatic paper feeding apparatus, more specifically, an automatic paper feeding apparatus which is attached to an image forming apparatus such as an electrophotographic copying machine or the like, and which feeds sheets one by one to the image forming portion of the image forming machine.

2. Description of the Prior Art

A conventional automatic paper feeding apparatus for a copying apparatus comprises a paper-feeder roller capable of feeding sheets by its own rotating, touching and pressing the top of the sheets stored on a sheet tray, as well as a sheet handling mechanism positioned at the downstream relative to the paper-feeder roller and having a transport roller and a separation roller touching and pressing the transport roller and capable of rotating in the reverse direction to the paper feeding direction. Further, this sheet-handling mechanism also has a guide plate, which guides the sheets fed through the paper-feeder roller to the nipping portion between the transport roller and the separation roller.

However, since this conventional type automatic paper feeding apparatus has its guide plate secured to a copying apparatus, there is a possibility that when a lot of sheets are fed through the paper-feeder roller, the leading edges of the sheets may be caught and jammed between the transport roller and the guide plate. Additionally, the top end of the guide plate is preferably located closer to the separation roller so as to improve the sheet handling capability. However, because of being independent of the separation roller, there is a difficulty in precisely locating the guide plate closer to the separation roller. In particular, in the case of small-sized apparatus that utilize small-diameter rollers, these problems become more important.

SUMMARY OF THE INVENTION

Therefore, the object of the present invention is to provide an automatic paper feeding apparatus having the sheet handling capability to surely feed sheets one by one and preventing a paper jam in case that many sheets are fed between the transport roller and the guide plate in the sheet-handling mechanism, wherein the top end of the guide plate is allowed to be precisely located closer to the separation roller.

To realize the above object, an automatic paper feeding apparatus according to the present invention comprises means for storing a stack of sheets thereon, a paper-feeder roller for feeding sheets by its own rotation, touching the top of the sheet stack stored on the sheet storing means, a transport roller positioned at the downstream relative to the paper-feeder roller in the paper feeding direction and rotatable in the paper feeding direction, a separation roller touching and pressing the transport roller and rotatable in the reverse direction to the paper feeding direction, means for rotatably supporting the separation roller, the supporting means being pivotably provided to move in the direction where the separation roller touches with and separates from the transport roller, and being urged by an elastic member so as to cause the separation roller to be pressed toward the transport roller, and a guide plate for guiding a sheet into the nipping portion between the transport roller and the separation roller, which is disposed integrally with the suppporting means.

Further, an automatic paper feeding apparatus according to the present invention comprises said sheet storing means, said paper-feeder roller, said transport roller, said separation roller, said supporting roller, and a guide plate for guiding a sheet into the nipping portion between the transport roller and the separation roller, the guide plate being movably provided to enter and to leave a paper feeding path and having a contact portion which touches the supporting means for regulating the guide plate at a specified position.

With the automatic paper feeding apparatus of the present invention, sheets are fed from the top sheet by the rotation of the paper-feeder roller, and guided into the nipping portion between the transport roller and the separation roller. Then, out of the sheets having been guided into the nipping portion, only the top sheet is fed to the downstream, while the other sheets are fed back by the rotation of the separation roller. The guide plate has its position regulated integrally with the separation roller through the suppporting means; thus the position of the guide plate relative to the separation roller is maintained precisely. Additionally, when a lot of sheets are fed at one time, the guide plate leaves the paper feeding path together with or independent of the separation roller, thereby preventing a paper jam between the transport roller and the guide plate.

BRIEF DESCRIPTION OF THE DRAWINGS

These and other objects and features of the present invention will become apparent from the following description taken in conjunction with the preferred embodiments thereof with the reference of the accompanying drawings, in which.

DETAILED DESCRIPTION OF THE INVENTION

Figure 1:
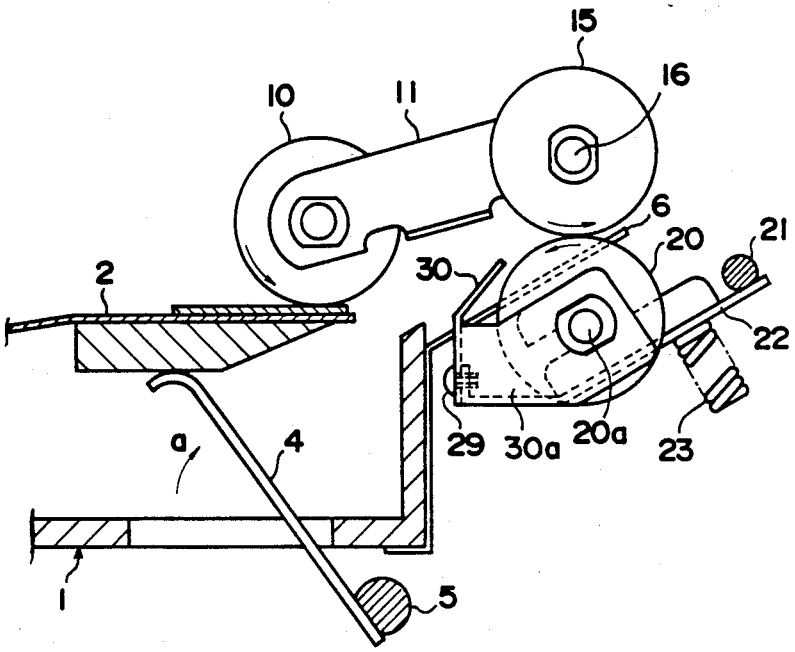
FIG. 1 is an elevational view partly in section showing a first embodiment of the invention.
Figure 2:
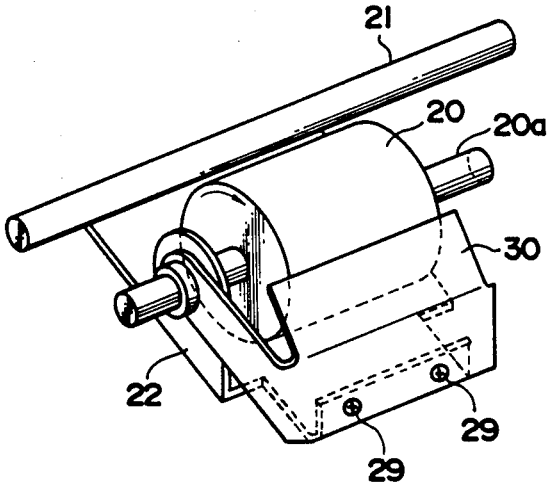
FIG. 2 is a perspective view showing a separation roller portion of the first embodiment.

[First Embodiment, Refer to FIGS. 1 and 2]

FIGS. 1 and 2 show a well-known automatic paper-feeder cassette 1, which is detachable from a paper feeding inlet of a main body of a copying apparatus. On the bottom of the cassette 1 is disposed a sheet storing plate 2, which can pivotably move up and down on a hinge fitting (not shown) provided at the rear end thereof. The sheet storing plate 2 is elevated by an elevating plate 4. The elevating plate 4, which can pivotably move on a pivot 5, is actuated in the direction of an arrow a by a motor (not shown). By turning the motor on and off, the height of the sheet storing plate 2 is automatically regulated so that the top of the sheets stored on the sheet storing plate 2 is constantly at the same level.

A transport roller 15 is rotatably disposed on a pivot 16 as shown in the figure. A paper-feeder roller 10, which is attached to the end of a paper-feeder roller frame 11 capable of pivotably moving on the pivot 16, can touch and press the top of the sheets stored on the sheet storing plate 2.

A separation roller 20, which is attached to a separation roller frame 22 capable of pivotably moving on a pivot 21, resiliently touches and presses the transport roller 15 by the pressing force of a helical compression spring 23.

The respective above-mentioned rollers 10, 15 and 20 are rotated counterclockwise by a driving system (not shown). The respective rotations are turned on or off at a specified timing.

A guide plate 30 not only has its side projection 30*a* engaged with a pivot 20*a* of the separation roller 20 but also has its front portion secured to the frame 22 with screws 29. The guide plate 30 is so arranged that its top end portion is protruded into the paper feeding course leading from the paper-feeder roller 10 to the nipping portion between the rollers 15 and 20.

Further, on the paper feeding course is located an auxiliary guide plate 6 secured to the front side of the cassette 1.

The operation of the automatic paper feeding apparatus constituted as mentioned above is described below.

The paper-feeder roller 10 touches and presses the top of the sheets stored on the sheet storing plate 2 due to its own weight. The pressure of the paper-feeder roller 10 on the sheets (paper-feeding pressure) is approximately in the range of 100 g to 250 g, and if necessary, is regulated by providing an auxiliary spring (not shown).

When a paper feeding signal is output, the respective rollers 10, 15 and 25 are rotated counterclockwise. Then, the sheets stored on the sheet storing plate 2 are fed from the top sheet in accordance with the rotation of the paper-feeder roller 10, and then guided by the guide plate 30 into the nipping portion between the rollers 15 and 20. In this case, two or three sheets are simultaneously fed together from the cassette 1 due to the friction between the sheets, wherein only the top sheet is fed to the right in the figure by the rotation of the transport roller 15 and the other sheets are fed back to the side of the cassette 1 by the reverse rotation of the separation roller 20. The one sheet having been fed is transported to the image forming portion through a transport roller (not shown).

As mentioned above, sheets can be handled to be fed one by one between the rollers 15 and 20. Assuming that the friction between the transport roller 15 and the top sheet is $\mu 1$and the friction between the separation roller 20 and the bottom sheet is $\mu 2$ and the friction between any two of the sheets is $\mu 3$, such handling is enabled by designating the relationship of these frictional forces as follows:

$$\mu 1 > \mu 2 > \mu 3$$

In the case of handling sheets as mentioned above, when many sheets are fed by the rotation of the paper-feeder roller 10, the guide plate 30 has a large pressure exerted upon it, whereby the guide plate 30 and the separation roller 20 move down against the pressing force of the helical compression spring 23 and leave the paper feeding path.

More specifically, with this embodiment, because of being attached to the frame 22, the guide plate 30 can be more precisely located relative to the separation roller 20, i.e. the top end of the guide plate 30 can be precisely located closer to the separation roller 20, thereby allowing sheets to be more effectively handled. In addition, the guide plate 30 can leave the paper feeding path together with the separation roller 20, thereby preventing a paper jam between the transport roller 15 and the top end of the guide plate 30. Further, since the guide plate 30 moves in conjunction with the separation roller 20, the positional relationship between the guide plate 30 and the separation roller 20 is constantly maintained.

Figure 3:
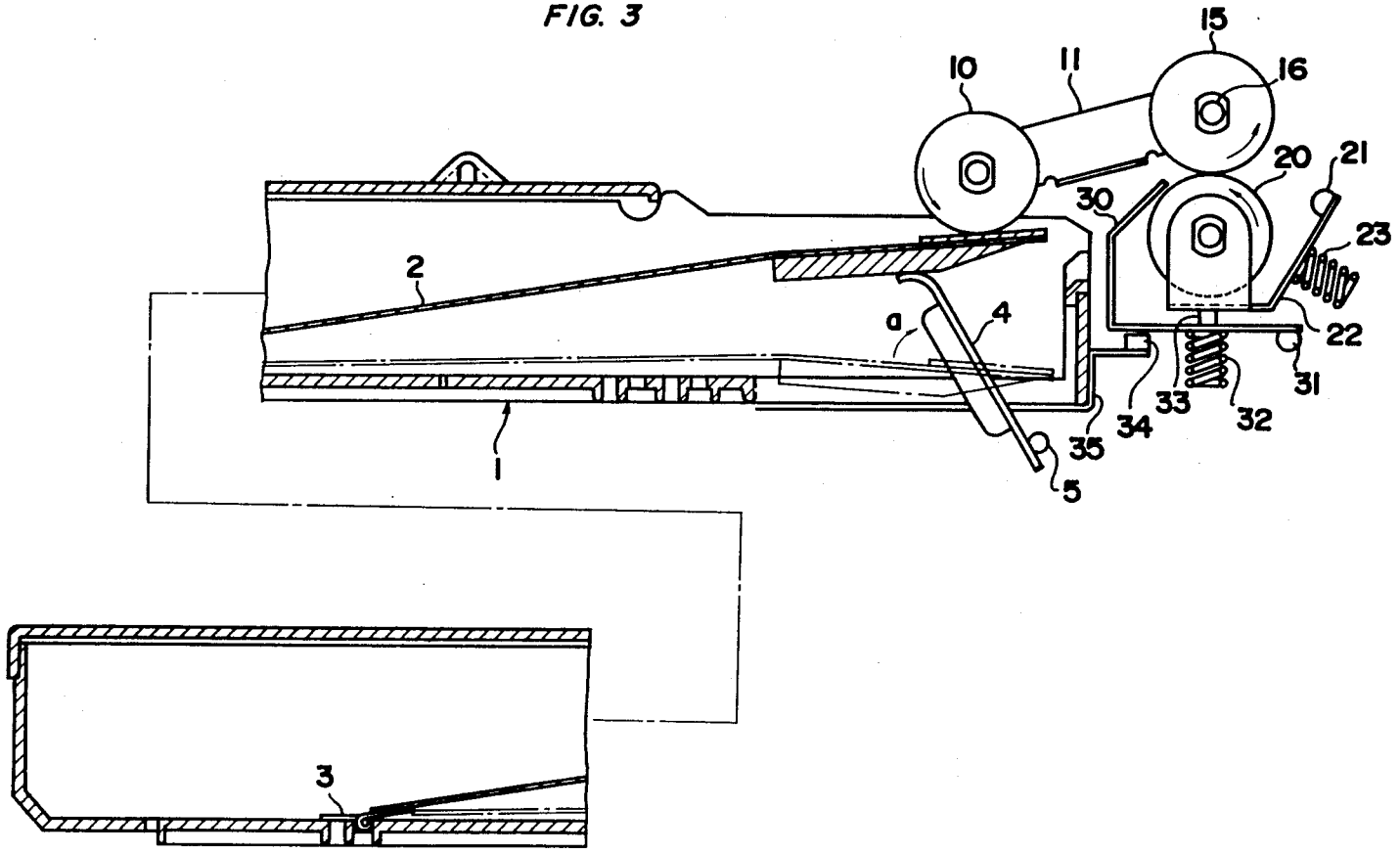
FIG. 3 is an elevational view partly in section showing a second embodiment of the invention.

[Second Embodiment, Refer to Fig. 3]

With a second embodiment shown in FIG. 3, the guide plate 30, which can pivotably move up and down on a pivot 31, is constantly pressed upward by the pressing force of a helical compression spring 32. Further, the limits within which the guide plate 30 can pivotably move up and down are regulated by an upper stopper 33 and a lower stopper 34. The upper stopper 33 is secured to the back of the frame 22, and the lower stopper 34 is secured to the front side of the cassette 1 through a bracket 35. More specifically, the guide plate 30 has its position regulated by the upper stopper 33, whereby the top end of the guide plate 30 is protruded into the paper feeding course leading from the paper-feeder roller 10 to the nipping portion between the rollers 15 and 20.

Incidentally, the other constituents of this embodiment are the same as those of the first embodiment.

With this embodiment constituted as mentioned above, the operation for handling sheets is the same as that of the first embodiment. However, with this second embodiment, when many sheets are fed through the paper-feeder roller 10, the guide plate 30 can independently and pivotably move downward against the pressing force of the helical compression spring 32 and leave the paper feeding path, thereby preventing a paper jam between the transport roller 15 and the top end of the guide plate 30. In addition, by attaching the upper stopper 33 for the guide plate 30 on the frame 22, the top end of the guide plate 30 is allowed to be precisely positioned closer to the separation roller 20. These effects are the same as in the first embodiment.

The positional limits to which the guide plate 30 can pivotably move down is regulated by the lower stopper 34 so as to prevent the guide plate 30 from independently moving down too far and interfering with the separation roller 20.

Figure 4:
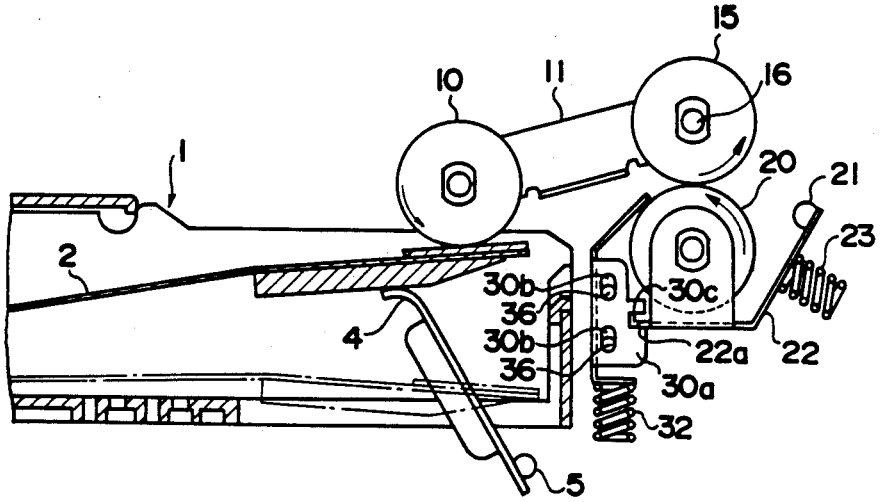
FIG. 4 is an elevational view partly in section showing a third embodiment of the invention.

[Third Embodiment, Refer to FIG. 4]

With a third embodiment shown in FIG. 4, by setting pins 36 and 36 in long holes 30*b* and 30*b* provided on the side projection 30*a* of the guide plate 30, the guide plate 30 is allowed to move up and down while being constantly pressed upward by the helical compression spring 32. The positional limits within which the guide plate 30 can move up and down are regulated by a stopper 22*a* rovided on the end of the frame 22. The stopper 22*a* regulates the guide plate 30 by touching the upper and lower edges of a notch 30a provided to the side projection 30*a* of the guide plate 30.

Additionally, the other constituents of this embodiment are the same as those of the second embodiment.

Figure 5:
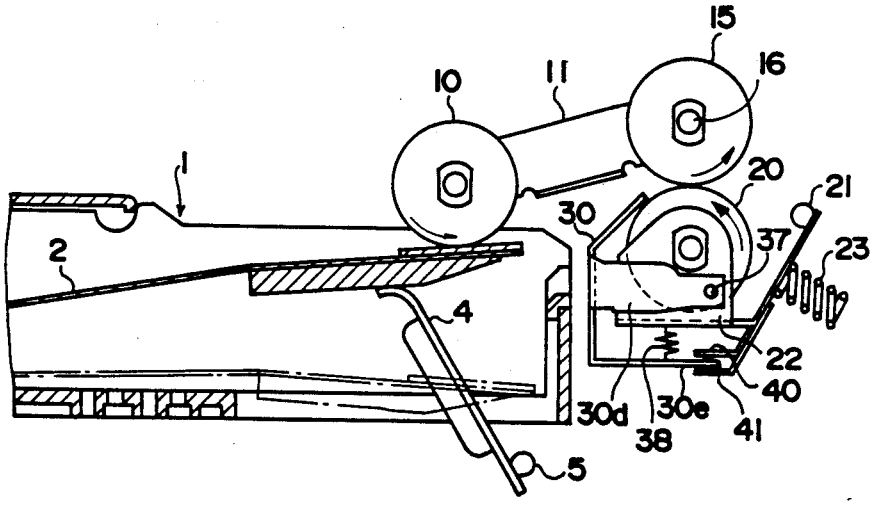
FIG. 5 is an elevational view partly in section showing a fourth embodiment of the invention.

[Fourth Embodiment, Refer to FIG. 5]

With a fourth embodiment shown in FIG. 5, the pivotal guide plate 30 has its side projection 30*d* attached to the frame 22 through a pin 37, and is constantly drawn upward by a helical tension spring 38. The limits within which the guide plate 30 can move up and down are regulated by stoppers 40 and 41 secured to the frame 22. The stoppers 40 and 41 regulate the guide plate 30 by touching the other end of the guide plate 30.

The other constituents of this embodiment are the same as those of the second and third embodiments, and the operations and effects of the constituents are also the same as in the second and third embodiments. However, since the guide plate 30 is pivotably attached to the frame 22, the separation roller 20 does not receive the drawing force of the helical tension spring 38, whereby the separation pressure to the transport roller 15 can be regulated only by the pressing force of the helical compression spring 23. This effect is the same as in the first embodiment.

Further, the automatic paper feeding apparatus according to the present invention is not limited to the above-mentioned embodiments, and various modifications are allowed providing the essential points of the present invention are not changed.

In particular, when the guide plate 30 can leave the paper feeding path independent of the separation roller 20 as shown in the second, third and fourth embodiments, wherein an arrangement is provided whereby the separation roller 20 and the top end of the guide plate 30 are shaped like a comb to lap over each other, the possibility of having the guide plate 30 move down and interfere with the separation roller 20 is eliminated. Therefore, in this case, neither of the lower stoppers 34 and 41 are necessary.

What is claimed is:

1. An automatic paper feeding apparatus comprising:

means for storing a stack of sheets thereon;

a paper-feeder roller for feeding sheets by its own rotation, touching the top of the sheet stack stored on said sheet storing means;

a transport roller positioned at the downstream relative to said paper-feeder roller in the paper feeding direction and rotatable in the paper feeding direction;

a separation roller touching and pressing said transport roller and rotatable in the reverse direction to the paper feeding direction;

means for rotatably supporting said separation roller, the supporting means being pivotably provided to move in the directions where said separation roller touches with and separates from said transport roller, and being urged by an elastic member so as to cause said separation roller to be pressed toward said transport roller; and a guide plate for guiding a sheet into the nipping portion between said transport roller and said separation roller, the guide plate being movably provided to enter and to leave a paper feeding path and having a contact portion which touches said supporting means for regulating the guide plate at a specified position;

wherein said guide plate moves to leave the paper feeding path independently of said separation roller when many sheets are fed by said paper-feeder roller.

2. An automatic paper feeding apparatus as claimed in claim 1, wherein said transport roller is located at an upper position and said separation roller is located at a lower position.

3. An automatic paper feeding apparatus as claimed in claim 1, wherein said guide plate is pressed toward the paper feeding path by a second elastic member so as to cause said contact portion to touch said supporting means, whereby said guide plate is regulated at a specified position.

4. An automatic paper feeding apparatus as claimed in claim 1, wherein said guide plate is pivotably attached to said supporting means and is pressed toward the paper feeding path by a second elastic member so as to cause said contact portion to touch said supporting means, whereby said guide plate is regulated at a specified position.

5. An automatic paper feeding apparatus as claimed in claim 1, wherein said guide plate is adapted to move independently of said separation roller within a predetermined area so as not to interfere with said separation roller.

6. An automatic paper feeding apparatus as claimed in claim 5, wherein said supporting means has a regulating portion for regulating the up-and-down movement of said guide plate by touching said contact portion of said guide plate.

* * * * *